US005520581A

United States Patent [19]

Mazzoli

[11] Patent Number: 5,520,581

[45] Date of Patent: May 28, 1996

[54] POOL ANGLES TRAINER

[76] Inventor: Charles W. Mazzoli, 256 N. Collingwood Ave., Syracuse, N.Y. 13206-2204

[21] Appl. No.: 532,089

[22] Filed: Sep. 22, 1995

[51] Int. Cl.[6] ..... A63D 15/08

[52] U.S. Cl. ..... 473/2

[58] Field of Search ..... 473/2

[56] References Cited

U.S. PATENT DOCUMENTS

| | | | |
|---|---|---|---|
| 2,537,228 | 1/1951 | Matson | 473/2 |
| 3,220,122 | 11/1965 | Miller | 473/2 |
| 3,299,537 | 1/1967 | Franks | 473/2 |
| 3,463,593 | 8/1969 | Horan | 473/2 |
| 4,027,883 | 6/1977 | Batori | 473/2 |
| 4,082,270 | 4/1978 | Josenhans | 473/2 |
| 4,178,694 | 12/1979 | Bonney | 473/2 |
| 5,125,652 | 6/1992 | Davis | 473/2 |
| 5,154,415 | 10/1992 | Zotos | 473/2 |
| 5,275,398 | 1/1994 | Compton | 473/2 |
| 5,338,262 | 8/1994 | Hayes | 473/2 |

*Primary Examiner*—Theatrice Brown
*Attorney, Agent, or Firm*—August E. Roehrig, Jr.

[57] ABSTRACT

A bank shot teaching or training device including a pair of arms pivotally supported on a base and positionable relative to teach other by means of indicia formed on the base and the arms such that the angle on the interior face of each arm will be equal relative to an imaginary center line normal to the base and equidistant between the pivot points. The base and arms are positionable on the playing surface of the billiard or pool table with an edge of the base being positionable along the cushion rail beneath the point of impact of a ball with the cushion.

5 Claims, 2 Drawing Sheets

POOL ANGLES TRAINER

BACKGROUND OF THE INVENTION

This invention relates in general to a training accessory for use with pool or billiard tables to improve a players skill and, in particular, to a lightweight portable device that may be placed on the table playing surface to teach a player or to increase a player's skills in shooting angle or "bank" shots.

More specifically, but without restriction to the particular use which is shown and described as a preferred embodiment, this invention relates to a teaching or training aid positionable upon the playing surface of a table, but out of interference with the contact surface of the cushion which surrounds the playing surface to enable the user to train and practice banking a ball into the cushion and rebounding the ball in a desired manner in order to strike another ball or move into a particular desired position.

One of the aspects of playing the game of billiards or pool is the banking of a ball from a table cushion so that the ball will rebound in a particular manner to accomplish a desired purpose. That purpose may be to strike another ball to move the struck ball into a pocket, or to move the struck ball and cue ball into particular locations. One of the more difficult skills required in these games, is the ability to hit a ball against the rebounding cushion so that the ball will strike another ball in a particular manner to achieve these purposes.

While it is known that the angle of incidence will equal the angle of rebound, the implementation of this theory into actual practice requires a skillful hand, a practiced eye and a lot of practice. There is no substitute for developing this skill if one is to be a successful billiards player. The knowledge of angles required to properly perfect such a shot is only developed through much practice. Even though the angle of incidence is supposed to equal the angle of rebound, when a ball is directed to the cushion edge at a point at which the acute angle of an imaginary line between the center of the ball and the point of impact on the cushion is equal to the acute angle of an imaginary line between the desired impact point or end destination of that ball and the same point on the rebounding cushion, it sometimes appears that the laws of physics do not exist on a pool table.

The reason such a "lines eye" view is not totally accurate, is that the rebound cushion is not an incompressible material. The rebound cushion is generally made of felt, covering an elastomeric material such as rubber, which is compressed when the ball strikes the rebound cushion and returned to its precompressed configuration when the ball is deflected from the theoretical bank line. The actual deflection from the theoretical bank line is affected by the speed of the ball when it hits and compresses the cushion, and the spin on the ball which will cause the ball to move laterally along the felt material covering the rebound cushion during the compressing and rebounding contact. The amount of deflection is also affected by the speed of the spin, and the direction of the spin on the ball. Therefore, while in theory the ball should rebound from the cushion at the same angle that the ball strikes the cushion, in practice this does not happen. It is only through training and practice that the skill required for a successful bank shot is perfected.

While various devices have been developed in order to practice the development of this skill, such as those patented devices located in a pre-examination search conducted before the filing of the application for this patent, and disclosed on the Information Statement submitted by the inventor with the filing of this application, such devices appear to be cumbersome in use, complicated to set up, expensive, or do not give a true and accurate simulation of a bank shot during play.

SUMMARY OF THE INVENTION

It is, therefore, an object of this invention to improve devices for use in increasing a players ability in the game of billiards or pool.

Another object of this invention is to permit the practice of bank shots under conditions which occur during a game of billiards or pool.

A further object of this invention is to permit a player to practice and vary different aspects of a bank shot such as the speed of the ball, the speed of the spin, and the direction of spin along the same angle of attack in order to practice the effect such variations will have on the resultant shot.

These and other objects are attained in accordance with the present invention wherein there is provided a bank shot teaching or training device including a pair of arms pivotally supported on a base and positionable relative to each other by means of indicia formed on the base and the arms such that the angle on the interior face of each arm will be equal relative to an imaginary center line normal to the base and equidistant between the pivot points. The base and arms are positionable on the playing surface of the billiard or pool table with an edge of the base being positionable along the cushion rail beneath the point of impact of a ball with the cushion.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF THE PREFERRED EMBODIMENT

Figure 1:
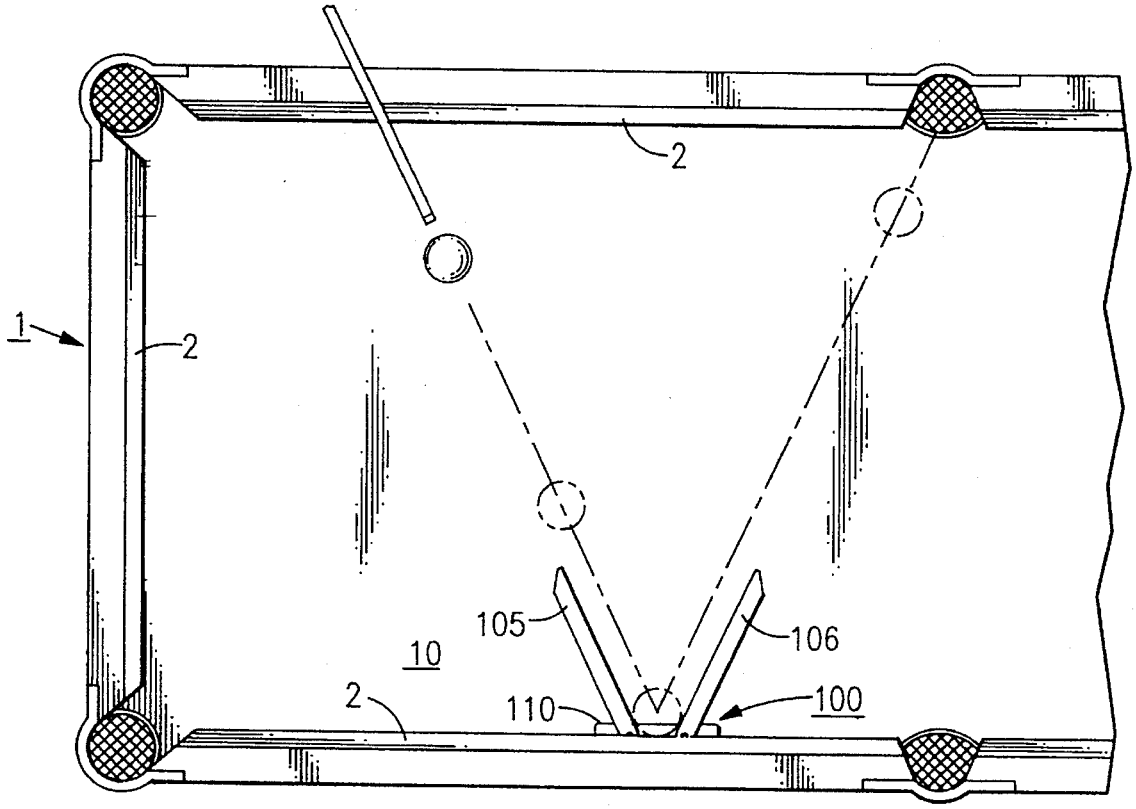
FIG. 1 is a planar view of a portion of a billiard or pool table showing the invention in position and use to practice banking a cue-ball from the rail cushion on the opposite side of the table into an opposed side pocket.
Figure 2:
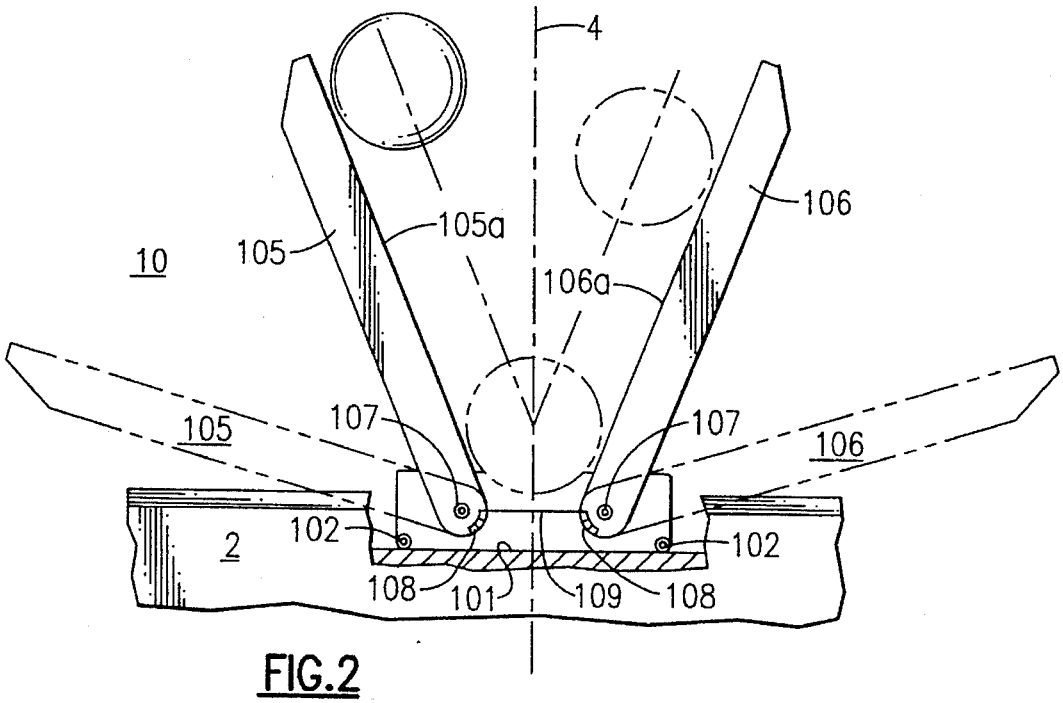
FIG. 2 is an enlarged planar view of the invention illustrating the pivotal movement of the guide arms for varying the practice angle and illustrating the manner in which the base is positioned to permit the device to be used on the playing surface in a manner simulating play during a game.

Referring now to FIGS. 1 and 2, there is shown a pool or billiard bank shot training and teaching device 100 positionable upon the playing surface 10 of a pool or billiard table 1. The bank shot training device 100 includes a base 110 which supports two arms 105 and 106. One end of each of the arms 105, 106 is pivotally connected to the base by a pivot connection 107 with the connected end of each end of each arm having indicia 108 formed thereon. The pivotal connection 107 of each arm 105 and 106 permits the indicia 108 to be selectively aligned with a base line 109 formed in the base plate 110. The base line 109 is positioned relative to the base plate 110 to be parallel with a longitudinal edge 101 of the base plate which, in use, engages the lowermost portion of the rubber cushion or rail 2 near the playing surface 10. Preferably the base line 109 and pivot points 107 lie on the same line, and in use are positionable directly below the outer edge 3 of the rubber cushion or rail 2.

Figure 3:
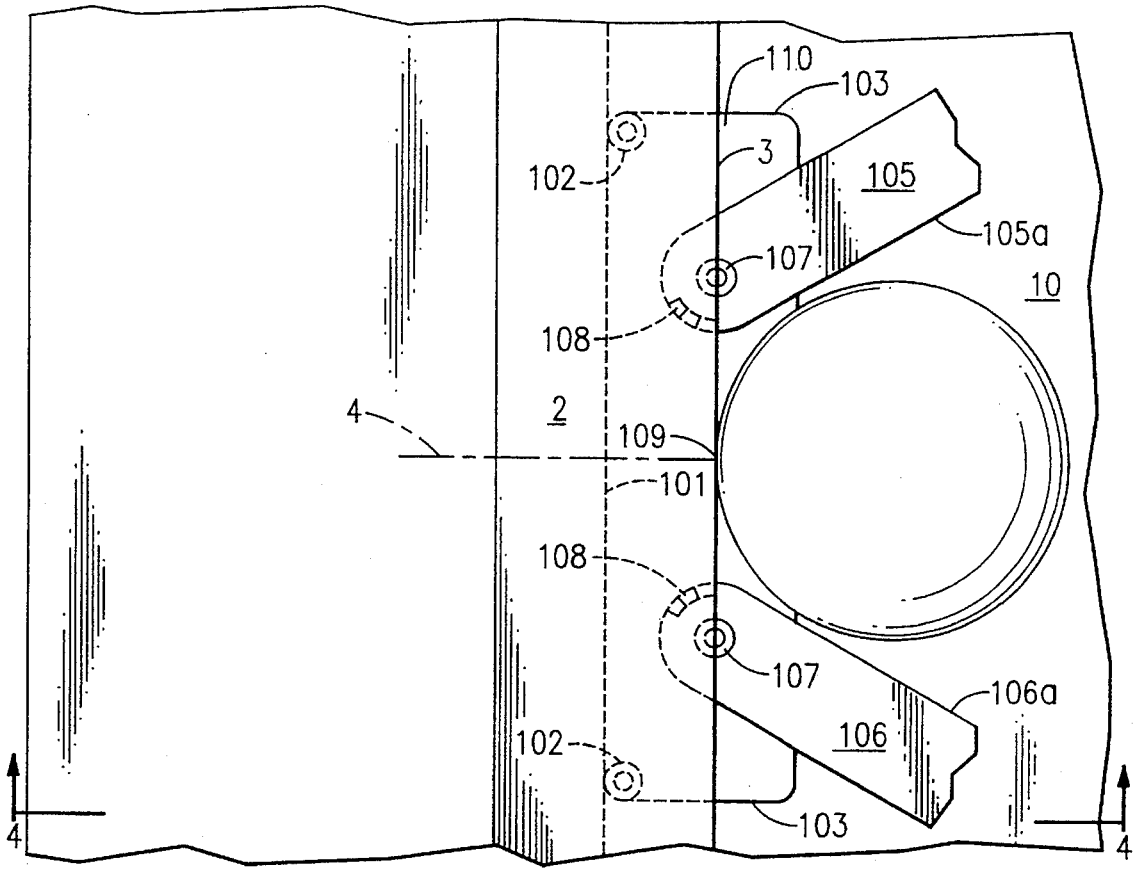
FIG. 3 is an enlarged planar view of a portion of the invention to better illustrate the components thereof.
Figure 4:
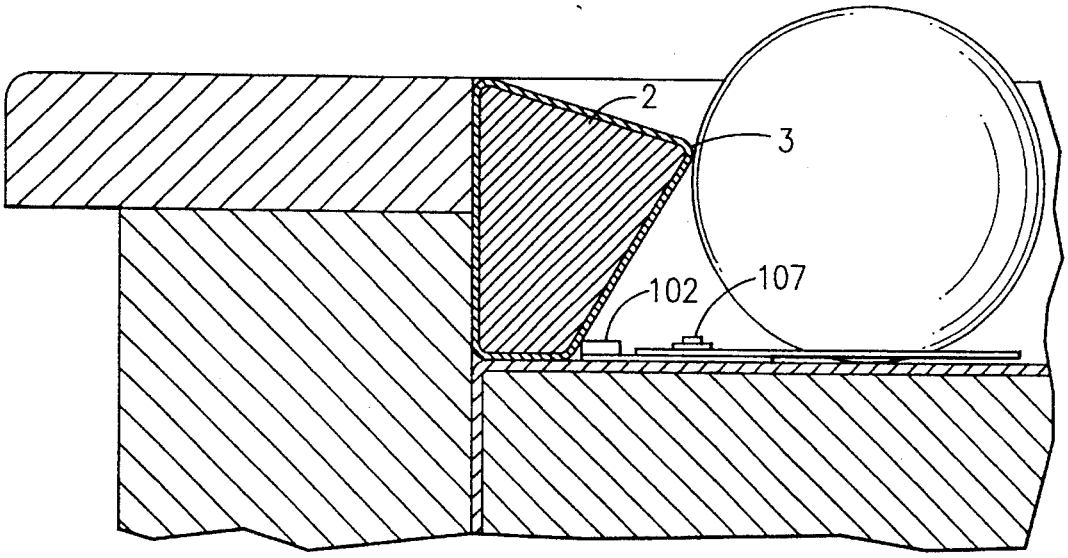
FIG. 4 is a partial cross sectional view of FIG. 3 taken along the lines 4—4.

In use the distal end of each of the arms 105, 106 is moved until the complimentary indicia 108 marked on each of these arms is aligned with the base line 109 best shown in FIGS. 2 and 3. In this manner the interior edge 105*a*, 106*a* of each arm will be at the same relative angle to a projected longitudinal center line 4 passing normal to the base line 109 at a position equidistant from both pivots 107. A pair of stops 102 are carried by the base plate 110 one each positioned adjacent to the interior corner of the base plate 110 where the cushion abutting edge 101 thereof meets the rubber cushion or rail 2, and an adjacent edge 103 extends normal to and outwardly therefrom. In this manner the stops 102, as best illustrated in FIGS. 3 and 4, correctly position the base plate 110 relative to the rubber cushion or rail 2.

As will be seen, in use the base plate 110 is positioned on the playing surface 10 of the table with the edge 101 and stops 102 thereof abutting the lower portion of the table cushion or rail 2 in a position which will not interfere with a ball contacting and rebounding from the cushion rail. The two arms 105 and 106 are positioned such that the angle thereof of each relative to the center line 4 extending normal to the base line 109 is equal, by matching the angle positioning indicia 108 of each with the base line 109. In this manner, the angle of impact of a ball moving along the interior edge of one of the arms e.g. 105*a* will equal the angle of rebound of the ball from the rail 2 moving along the interior edge 106*a* of the other arm, at least in theory. With the teaching aid 110 positioned in this manner on the playing surface 10, but out of interference with the movement of the ball over the playing surface or impacting the rubber cushion or rail 2, a player can practice shooting a ball down one arm using the interior edge thereof as a guide to impact against the rubber cushion or rail and rebound therefrom. After practicing striking the ball in the ball's center at various speeds to observe and learn the effect of speed on a bank shot, the player can apply spin to the ball to learn the effect such variation will have on the rebound, and vary the direction of spin and the amount of spin on the ball to determine these effects on the rebound. In this manner the player can utilize the device to practice and observe the rebound of the ball from the rail as it will actually occur in a game.

While the invention has been described with reference to a preferred embodiment, it will be understood by those skilled in the art that various changes may be made and equivalents may be substituted for elements thereof without departing from the scope of the invention. In addition, many modification may be made to adapt a particular situation or material to the teachings of the invention without departing from the essential scope thereof. Therefore, it is intended that the invention not be limited to the particular embodiment disclosed in the specification and shown in the drawings as the best way presently known for carrying out this invention, but that the invention will include all embodiments falling within the scope of the appended claims.

I claim:

1. A rebound angle practice apparatus for training a user in the skill of rebounding a ball from the cushion rail of a pool or billiard table in a particular manner comprising:

a planar base member positionable on the playing surface of a pool or billiard table which has a cushion rail extending about the table playing surface, said base member having an edge thereof positionable parallel to and adapted to abut the cushion rail at a position adjacent to the junction of the cushion rail with the playing surface, a first and a second guide arm each of said guide arms positionable on the playing surface of a pool or billiard table and pivotally connected to said base member at one end thereof, each of said pivotally connected arm ends having indicia carried thereon to position each of said arms at a predetermined angle relative to said base member and relative to each other, for providing a guide adjacent to which a ball may be passed to impact a cushion rail and adjacent to which the ball may be passed when rebounding therefrom.

2. The apparatus of claim 1 wherein said base member includes a reference mark extending along a center line passing through the center of the pivotal connection of each of said guide arms with said base member to assist in positioning said guide arms in a predetermined angular position.

3. The apparatus of claim 2 wherein said center line is positioned on said base member to lie when in use in a plane extending normal to the playing surface through the outermost edge of the cushion rail against which a ball is rebounded.

4. The apparatus of claim 3 wherein said indicia carried on said pivotally connected arms is positioned to be moved adjacent to said center line to position said guide arms.

5. The apparatus of claim 1 wherein said base member includes a pair of spaced apart positioning stops carried by said base member along an edge thereof positionable in use to abut the cushion rail at a position adjacent to the junction of the cushion rail with the playing surface to facilitate proper positioning of the rebound angle practice apparatus when in use.

* * * * *